United States Patent [19]

Schimmel

[11] 4,319,417

[45] Mar. 16, 1982

[54] NAMEPLATE DEVICE AND KIT FOR MAKING SAME

[75] Inventor: Norbert Schimmel, Kings Point, N.Y.

[73] Assignee: New Hermes Incorporated, New York, N.Y.

[21] Appl. No.: 91,643

[22] Filed: Nov. 5, 1979

[51] Int. Cl.[3] ..... G09F 3/18

[52] U.S. Cl. ..... 40/10 R; 40/606; 40/160

[58] Field of Search ..... 40/152, 584, 160, 1.5, 40/152, 10; D6/242; D11/129, 132, 133, 139; D20/15

[56] References Cited

U.S. PATENT DOCUMENTS

| | | | |
|---|---|---|---|
| D. 178,696 | 9/1956 | Ross | D6/242 |
| D. 179,548 | 1/1957 | Olson | D20/15 |
| D. 180,496 | 6/1957 | Sorensen | D20/15 |
| D. 208,543 | 9/1967 | Van Ostrand | D20/1 |
| D. 243,378 | 2/1977 | Tharp | D6/242 |
| 2,697,293 | 12/1954 | Greenhut | 40/152.1 X |
| 2,851,804 | 9/1958 | Roach | 40/160 |
| 2,876,972 | 3/1959 | Silverman | D6/242 X |
| 2,879,614 | 3/1959 | Baldanza | 40/622 |
| 3,691,663 | 9/1972 | Caven et al. | 40/584 X |
| 3,822,487 | 9/1974 | Koch | 40/620 |

FOREIGN PATENT DOCUMENTS

| | | | |
|---|---|---|---|
| 661692 | 11/1951 | United Kingdom | 40/622 |

*Primary Examiner*—Gene Mancene
*Assistant Examiner*—Wenceslao J. Contreras
*Attorney, Agent, or Firm*—Seidel, Gonda, Goldhammer & Panitch

[57] ABSTRACT

The nameplate device includes a shadow box mounted on a support. A spacer is secured to the center of the rear wall of the shadow box and to the rear face of an engraved plate. The engraved plate is parallel to the rear wall and spaced evenly from the side walls of the shadow box in a manner so that the details of how the plate is attached to the rear wall are concealed.

3 Claims, 5 Drawing Figures

NAMEPLATE DEVICE AND KIT FOR MAKING SAME

BACKGROUND

Nameplate devices are known. For example, see U.S. Pat. Nos. D-115,418 and 3,566,526. U.S. Pat. No. 3,877,162 is also relevant for a display of a medalion and the teaching of spacer 22 disclosed therein. Such prior art lacks a number of features of the present invention to be described hereinafter.

SUMMARY OF THE INVENTION

The present invention is directed to a nameplate device including a shadow box. The shadow box has a rear wall connected to a top wall, bottom wall, and side walls. A spacer is secured to the center of the rear wall within the shadow box. A plate engraved on a front face is provided. The rear face of said plate is adhesively secured to the spacer. The plate is disposed within the shadow box parallel to the rear wall and spaced inwardly from the side, top and bottom walls whereby the manner in which the plate is supported is concealed.

In the preferred embodiment of the present invention, the nameplate is a laminate which has been engraved on its front face so that the engraving is a different color as compared with that of the front face. Also, the rear wall of the shadow box is made from a plastic laminate while the other walls of the shadow box are made from a non-corrosive metal. The rear wall of the shadow box has a recess for receiving the spacer.

It is an object of the present invention to provide a nameplate device and kit for making the same which is simple, inexpensive and reliable whereby the manner in which the plate is supported within the shadow box is concealed.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
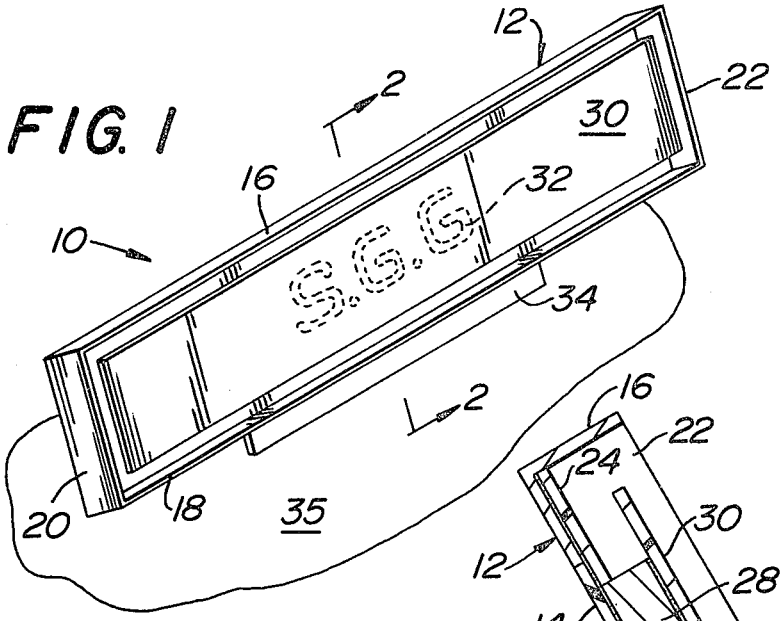
FIG. 1 is a perspective view of a nameplate device in accordance with the present invention.

Referring to the drawing in detail, wherein like numerals indicate like elements, there is shown in FIG. 1 a template device in accordance with the present invention designated generally as 10. The device 10 includes a shadow box 12 which includes a rear wall 14 connected at its periphery to a top wall 16, bottom wall 18, and side walls 20, 22.

Figures 4, 5:
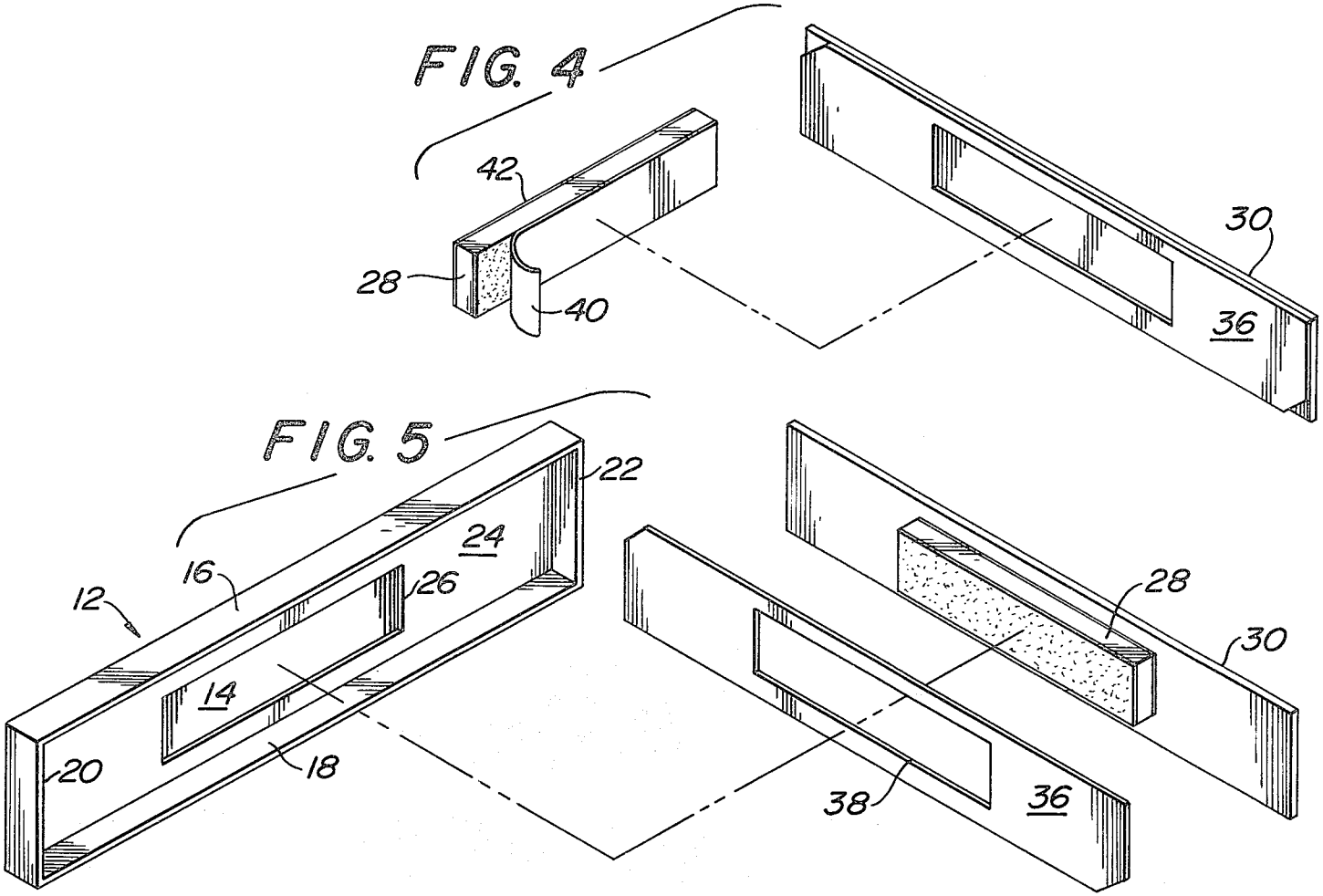
FIG. 4 is an exploded view of the nameplate, template and spacer.
FIG. 5 is an exploded view of the nameplate, template, spacer, and shadow box.

The rear wall 14 is preferably a laminate of different colored plastic material and includes an overlying layer 24. The surface of layer 24 within the shadow box is preferably a dark color such as black. Layer 24 is provided with a centrally disposed opening 26. See FIG. 5.

The walls 16, 18, 20 and 22 are preferably one integral piece of metal such as aluminum.

Figure 2:
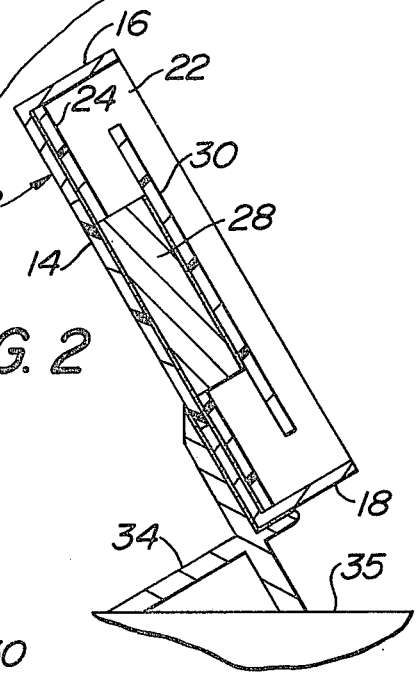
FIG. 2 is a sectional view taken along the line 2—2 in FIG. 1 and on an enlarged scale.
Figure 3:
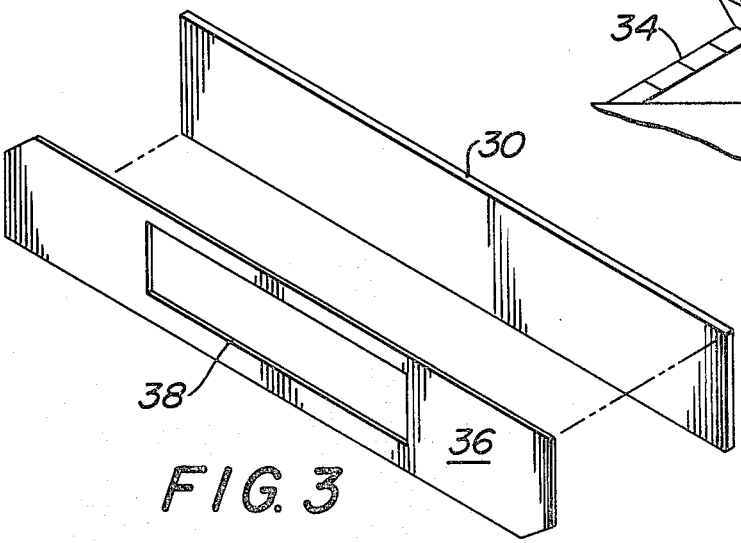
FIG. 3 is an exploded view of an engraved plate and a template.

A spacer 28 occupies the entirety of the opening 26 and is adhesively secured to the rear wall 14. The thickness of spacer 28 is less than in the height of the walls 16, 18, 20 and 22. See FIG. 2. A plate 30 has indicia 32 engraved on a front face thereof and has its rear face adhesively secured to a major face of the spacer 28. The dimensions of the plate 30 correspond generally to the dimensions of the shadow box whereby the periphery of plate 30 is spaced by a small uniform distance from each of the walls 16, 18, 20 and 22. Typically such small distance would be 3/16". Plate 30 typically has a length of 8 or 9" and a height of 1½".

The plate 30 is preferably a laminate of the type sold commercially by New Hermes Incorporated. The front face of plate 30 containing the engraved indicia 32 is of a different color from the color of the remainder of the laminate. Preferably the color of the front face of plate 30 matches the color of the shadow box walls 16, 18, 20 and 22. Any conventional support 34 may be provided to support the nameplate device 10 on a surface 35 which may be a person's desk.

The nameplate device 10 is preferably sold disassembled as a kit which may be readily assembled by the user. The kit includes a template 36 having diagonally opposite corners doubled. Except for the beveled corners, the periphery of the template 36 corresponds with the periphery of the plate 30. Template 36 is made from paperboard or the like and has a centrally disposed opening 38. The kit includes the spacer 28 having precious sensitive adhesive on opposite major faces thereof with each layer of adhesive temporarily protected by one of the films 40, 42. The kit also includes the shadow box 12 pre-assembled to the extent shown in FIG. 5.

On one surface of the template 36 there is printed the assembly instructions. Assembly of the device 10 includes attaching the template 36 to the rear face of the plate 30 by use of tape at each of the beveled corners. This centrally locates the opening 38 with respect to the periphery of the plate 30. Thereafter, film 40 on the spacer 28 is removed. The exposed adhesive surface on spacer 28 is placed within the opening 38. Opening 38 corresponds to the periphery of spacer 28. Pressure is applied to the spacer so as to cause the adhesive to bond to the rear face of the plate 30.

Thereafter, the spacer 36 is removed. Then film 42 is removed thereby exposing adhesive on the major face thereof. Spacer 28 with the plate 30 attached thereto is placed within the shadow box so that spacer 28 enters the opening 26. Thereafter, pressure is applied to the plate 30 to attain a good adhesive bond between the spacer 28 and the exposed portion of the rear wall 14 within the opening 26. This completes the assembly of the nameplate device 10. The periphery of the plate 30 will be uniformly spaced from each of the walls 16, 18, 20 and 22 while being disposed within the shadow box 12 whereby the manner in which plate 30 is supported is concealed. The color of the exposed face of the plate 30 matches the color of the shadow box walls while the engraved indicia 32 may be of a color which matches the color the exposed portion of layer 24. Thus, the present invention is simple and capable of being quickly assembled without any skill. At the same time, the device 10 produces an attractive structure taking advantage of the shadow box effect.

The present invention may be embodied in other specific forms without departing from the spirit or essential attributes thereof and, accordingly, reference should be made to the appended claims, rather than to the foregoing specification, as indicating the scope of the invention.

I claim:

1. A nameplate device comprising:

(a) a rigid shadowbox having a rear wall connected to a top wall, bottom wall and side walls;

(b) a rigid spacer secured to a central portion of said rear wall within the shadowbox, said rear wall having means thereon for registering the spacer in a central portion thereof, wherein said registering means includes a structure on said rear wall for mating with and positioning said spacer in a predetermined location on said rear wall inwardly of its periphery, said mating structure including an opening recessed in said rear wall, said rear wall being a laminate with the opening extending through one of the layers of the laminate;

(c) a plate having a front face and a rear face, the front face of said plate being engraved, the rear face of said plate being adhesively secured to said spacer, said plate being within the shadow box parallel to the rear wall and spaced inwardly from said top, bottom and side walls.

2. A nameplate device in accordance with claim 1 including a support for the shadowbox, said support being shorter than the shadowbox and supporting the shadowbox at an acute angle with respect to the horizontal.

3. A kit for assembling a nameplate device including a shadowbox having a rear wall connected to a top wall, bottom wall and side walls, a spacer having adhesive on opposite major faces thereof with the adhesive being protected by a removable film, a template having an opening for receiving and orientating the spacer with respect to a plate, said plate being engraved on a front face thereof, said template being adapted to register the spacer with respect to the periphery of a rear face of the plate before adhesively securing the spacer to such rear face of the plate and thereafter being expendable, said shadowbox rear wall having means thereon for registering said spacer with respect to the periphery of the rear wall before adhesively securing the spacer and engraved plate thereto.

* * * * *